United States Patent [19]

Neveu et al.

[11] 4,084,930

[45] Apr. 18, 1978

[54] APPARATUS FOR THE PRODUCTION OF A YARN HAVING A POTENTIAL CRIMP

[75] Inventors: Jean-Louis Neveu, Lozanne, France; Sylvio Melancon, 7235 Chateaubriand, Montreal, Quebec, Canada

[73] Assignees: Sylvio Melancon, Quebec, Canada; Agence Nationale de Valorisation de la Recherche, Neuilly (Seine), France

[21] Appl. No.: 735,747

[22] Filed: Oct. 26, 1976

[30] Foreign Application Priority Data

Oct. 30, 1975 France ..... 75 34012

[51] Int. Cl.[2] ..... B29F 3/02

[52] U.S. Cl. ..... 425/198; 425/378 S; 425/DIG. 49

[58] Field of Search ..... 425/198, 378 S, 379 S, 425/DIG. 49, DIG. 217

[56] References Cited

U.S. PATENT DOCUMENTS

| | | | |
|---|---|---|---|
| 2,013,688 | 9/1935 | Kinsella | 425/198 X |
| 2,791,802 | 5/1957 | Weber | 425/378 S X |
| 2,879,543 | 3/1959 | McDermott | 425/198 X |
| 3,041,048 | 6/1962 | Heijnis | 425/378 S X |
| 3,271,817 | 9/1966 | Kanbar | 425/378 S X |
| 3,360,597 | 12/1967 | Jones et al. | 425/198 X |
| 3,861,843 | 1/1975 | Keuchel et al. | 425/198 |

FOREIGN PATENT DOCUMENTS

| | | | |
|---|---|---|---|
| 923,661 | 4/1973 | Canada | 425/198 |
| 15,445 | 7/1965 | Japan | 425/198 |
| 22,527 | 9/1969 | Japan | 425/198 |

*Primary Examiner*—Robert L. Spicer, Jr.
*Attorney, Agent, or Firm*—Stevens, Davis, Miller & Mosher

[57] ABSTRACT

Apparatus for the production of yarn having a potential crimp which is achieved by varying the viscosity gradient in the mass of polymer upstream of the spinneret. The apparatus includes means for feeding polymer under pressure, a block which is connected to the outlet of the feeding means and a spinning head, including a spinneret formed with at least one row of holes, the spinning head being mounted on the block. At least one passage is defined through the block, for the passage of polymer from the feeding means to the spinneret, this passage having a frusto-conical upstream portion which converges in a downstream direction towards the spinneret. Heating or cooling means are provided on the block for imparting to the polymer, as it passes through the passage, a temperature differential between the polymer at the center of the passage and the polymer at the walls of the passage.

Means are also provided for receiving and possibly drafting the yarn which has been extruded through the spinneret.

9 Claims, 14 Drawing Figures

APPARATUS FOR THE PRODUCTION OF A YARN HAVING A POTENTIAL CRIMP

The present invention relates to apparatus for producing, by extrusion-spinning, yarns of continuous filaments which are capable of crimping and bulking after being drawn and optionally heat-treated. In the literature such yarns are sometimes called "yarns having potential crimp." This new apparatus is particularly suitable for, but not limited to, the production of polyolefin, especially polypropylene yarns.

The invention also relates to yarns thus obtained.

It has for some time been known to extrude yarns of continuous filaments which are capable of eventually crimping.

Initially it was proposed to extrude for each filament two different polymers either in side-by-side or in core and sheath relationship. This technique which is theoretically satisfactory requires the use of complex spinnerettes which are costly and fragile and hence this technique is of limited use.

It has also been proposed to produce such yarns from a simple polymer:- a) by depolymerising (U.S. Pat. No. 3,663,675); or
b) by degrading (U.S. Pat. No. 3,560,604); or
c) by heating (U.S. Pat. No. 3,651,193), or cooling (U.S. Pat. No. 3,577,498) the extruded yarn in asymmetrical manner.

For most textile applications the bulking and crimping properties of yarns so obtained were considered inadequate, without taking into account that such methods are quite difficult to practice.

In Canadian patents Nos. 785,195 and 884,962 it has been proposed to create a viscosity gradient in the mass of the polymer before it enters the spinnerette, in such manner as to obtain in each filament a viscosity which gradually increases from one side to the other side of the same filament. The crimp and bulk are then developed by heat treatment, optionally combined with drawings.

The appropriate apparatus for practicing this method essentially comprises:

an endless screw intended to bring the polymer in granular or pulverulent form to the spinnerette block, a block, such as a tube or a chamber, formed with a multitude of elongate or cylindrical passages and heated with the aid of a collar placed at one end so as to initiate a viscosity gradient which increases from the periphery to the center of the block, since the polymer situated on the periphery is overheated relative to the polymer situated in the center.

a passage for transferring the molten polymer, a preferably frustoconical, spinnerette provided with an array of concentric orifices, a zone where the newly extruded filaments are cooled by a ring of air, elements for receiving the thus extruded yarn of continuous filaments.

The potential crimp and bulk of these filaments are developed after drawing and heat treatment. In this manner there is obtained an elastic yarn having a substantially uniform helicoidal crimp, randomly distributed to have an inverted pitch, that is to say alternately S and Z, and finally an appreciable bulk.

Despite the satisfactory results obtained with this apparatus the latter still has a number of practical disadvantages which have until now limited its industrial development.

The use of an endless screw (for example of the kind described in U.S. Pat. No. 3,078,509) for the purpose of pushing the granular or pulverulent polymer is generally satisfactory for producing yarns in the labooratory. On the other hand, this device is unsuitable for the industrial production of yarn having potential crimp since, on the one hand it does not lead to the spinnerette block being homogeneously supplied, and on the other hand, the pressure which this endless screw exerts on the polymer is greater in the center of the block than on its periphery. This results in the adjuvants which one may which to add to the polymer, such as pigments, stabilizers etc., stagnating in the peripheral passages, which is particularly inconvenient when one wishes to pass from one production to another one.

The existence of multiple tubes requires complex machining and difficult cleaning and maintenance. This results in increased cost of the installation. Because of the thus created large contact surfaces of these multiple tubes with the polymer the latter is degraded and in the heart of the block the bridging effect of the walls causes the heat to diffuse, whereby the viscosity gradient is of diminished variation. Consequently the crimp and the bluk which are obtained are limited.

Finally, the production of such a device is limited to the melting capacity of the hot walls of the various tubings, which is frequently insufficient in up-to-date plants.

According to the present invention we provide apparatus for the production of a yarn having a potential or capability for crimp, such apparatus comprising means for feeding polymer under pressure, a block connected to the outlet of said feeding means, a spinning head including a spinneret formed with at least one row of holes, said spinning head being mounted on said block, a passage through said block, for the passage of polymer from the feeding means to the spinneret, the passage having a frusto-conical upstream portion converging in a downstream direction, means on said block for imparting to the polymer, as it passes through said passage, a temperature differential between the polymer at the center of the passage and the polymer at the walls of the passage and means for receiving the yarn extruded through the spinneret.

Such an apparatus is economical, easy to manufacture and to operate, the productivity is clearly enhanced and finally it makes it possible to obtain yarns the crimping, bulking and other properties of which are improved.

In one particular embodiment this central passage is a single one and consists of two interconnected truncated cones, the angle at the apex of the upstream cone being greater than the angle of the apex of the downstream cone.

In an advantageous embodiment the central passage is compartmented in the longitudinal direction by partitions of a material which is a poor conductor of heat.

In another embodiment, a filter is positioned between the transfer passage and the spinning head, this filter being inclined relative to a plane normal to the axis of the passage, whereby the dispersion of the viscosity gradient is further increased. A similar result may be obtained by using, instead of a planar inclined filter, a conical filter the apex of which is directed upstream, whereby a preferential distribution is imparted to the polymer before it passes into the spinnerette.

In an improved embodiment the central passage having a frusto-conical opening is surrounded by a concentric annular crown which extends over the full height of the block, the passage and the annular crown being joined together at their base by a perforated disc through which the mass of molten polymer can flow.

The apparatus according to the invention can be utilized with any thermoplastic, synthetic polymer capable of being extruded in molten form. It is nevertheless successfully utilized for the production of yarns having or capability crimp of polyolefins, more particularly isotactic polypropylene.

In order that the invention will more fully be understood, the following description is given, merely by way of example, reference being made to the accompanying drawings, in which.

Figure 1:
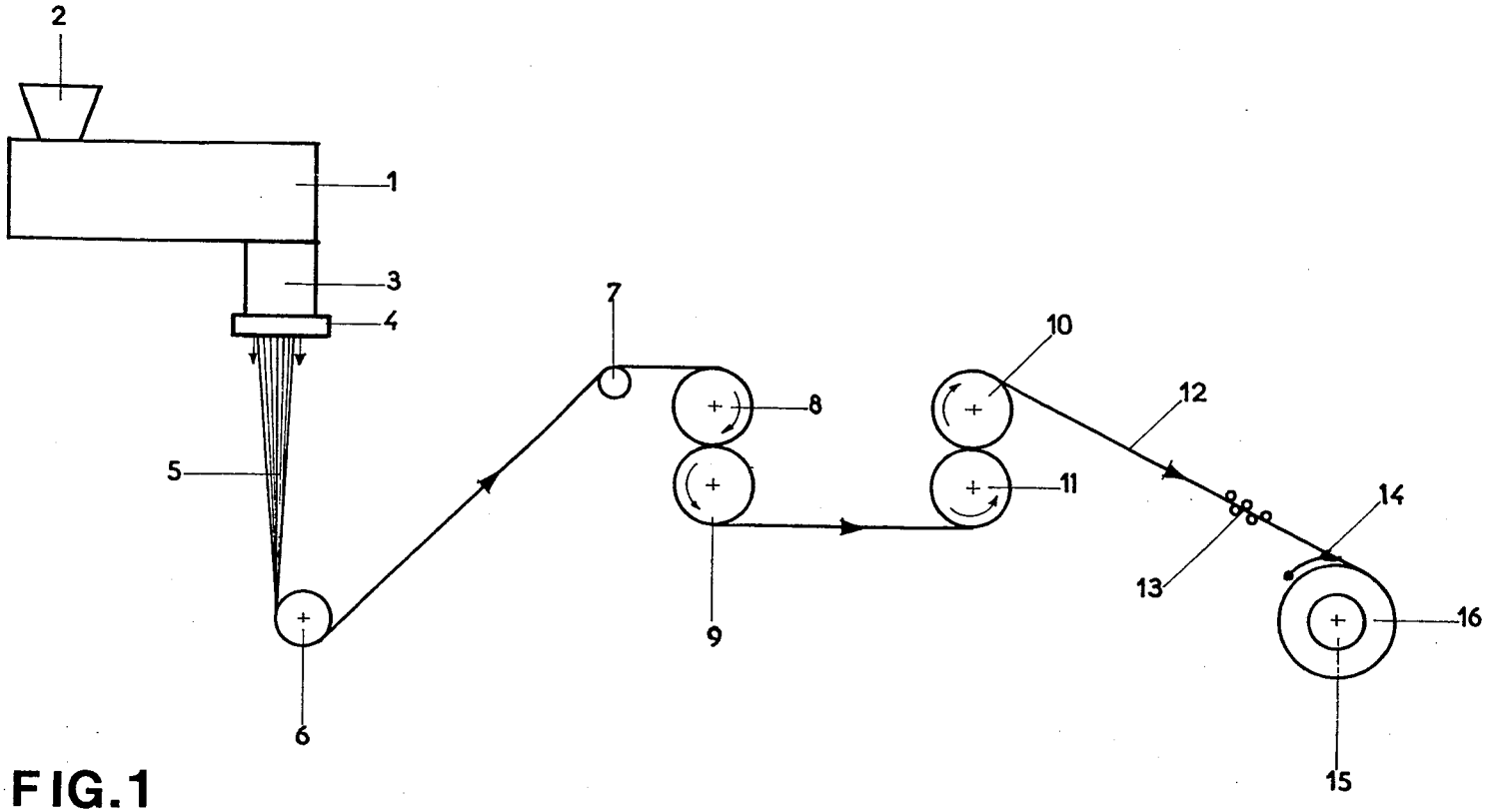
FIG. 1 is a schematic view of a complete installation for the production of potentially crimpable yarns.

Referring to FIG. 1, the installation essentially comprises a conventional screw extruder 1 on which are mounted a hopper 2 for charging polymer in granular or pulverulent form and a heating spinning head block 3.

At the base of the spinnerette cold air is injected along the path sechematically shown by the arrows 4, for example air at ambient temperature, so as to cool the bundle 5 of extruded filaments.

This cooled bundle 5 passes over two guide rollers 6 and 7, for example in the form of polyamide diabolos, and from there arrives at the drawing system which includes:

- a first delivery roller set including a roller 9 of duraluminium driven to rotate about its shaft and a pressure roller 8 covered by soft material (e.g. rubber, cork or felt) and mounted to idle about its shaft;
- a second set of drafting rollers similar to the first set, 11 corresponding to 9 and 10 to 8, respectively.

Each set of rollers is controlled by a variable, d.c. electric motor, not shown, which enables the speed ratios and hence the stretching ratios to be adjusted. If desired, one or more of the rollers may be heated in conventional manner or the assembly may even be placed inside a heating enclosure.

For the drawing system to be self-blocking, that is to say that the mounting should be positive, the path of the yarn over the rollers corresponds to the one which is shown.

When the drawn yarn 12 consisting of an assembly of parallel continuous filaments leaves the drawing system it passes into a winding compensator 13 which is intended to absorb jerks, and from there it arrives at the conventional reciprocating yarn feed 14 of the winding machine where it is wound on a spool 15 in the shape of the bobbin 16.

If desired, the drawing system may be replaced by successive sets whereby it becomes possible to effect gradual, especially cold, drawing.

Finally, the installation may comprise conventional extrusion-spinning devices such as sizing and finishing devices, etc.

The spinning head block 3 (see FIG. 2) essentially comprises:

- a connector 20 connecting this block 3 to the element (extruder 1, pump, pusher screw, etc) for feeding polymer under pressure,
- a clamping plate 21 connected to a boss 22 having a central bore through which the polymer to be extruded passes,
- a heated block 23 having extending at its centre a single passage 24, which is formed at its inlet end by a portion 25 of open, frustoconical configuration communicating at its smaller base with a cylindrical portion 26; this block 23 of aluminum or a lightweight alloy such as duraluminum is heated at its periphery by a collar or jacket 27 supplied with either electricity or a heat carrying fluid; the thermal control of this block 23 is ensured by a known, not shown, element such as a thermocontact or a temperature regulator and the displayed temperature is read on a member (thermometer, probe, etc.) positioned at 28,
- a second clamping plate 29 integral with the piece 32 and provided with a passage 34 keeps the block 23 in place with the aid of a plurality of tightening means 30 and 31 such as studs or nuts and bolts,
- the piece 32, which is integral with clamping plate 29, is of cast iron or steel and is heated by a collar or jacket 33. Aligned with the cylindrical portion 26 of passage 24 is a transfer passage 34, which brings the molten polymer to a variable viscosity gradient from the block 23 to the screen or sieve assembly 36 of the spinning head 35, for example by delivering this polymer in the form of layers,
- a spinning head 35 comprising at its inlet a screen or sieve 36, for example of metallic fabric or of sand, and at its outlet a spinnerette plate 37 provided with a multitude of orifices arranged in one or more rows,
- a cooling ring 38 enables a cooling fluid (e.g. air, inert gas, water vapor or solvent) introduced at 39 from a source, not shown, to flow longitudinally with respect to the bundle 5 of newly extruded filaments and thereby to cool it.

Figure 2:
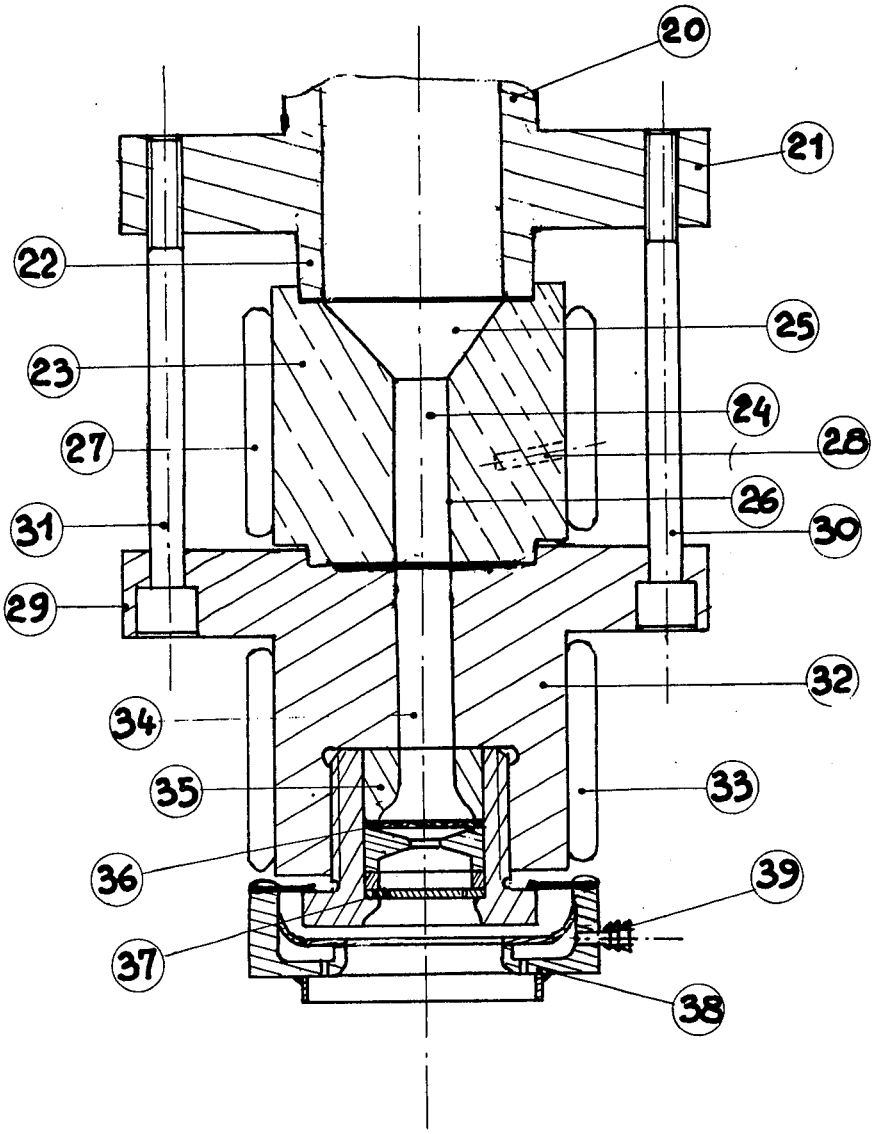
FIG. 2 is a longitudinal cross-section of one form of spinning head block of such an installation.
Figure 8:
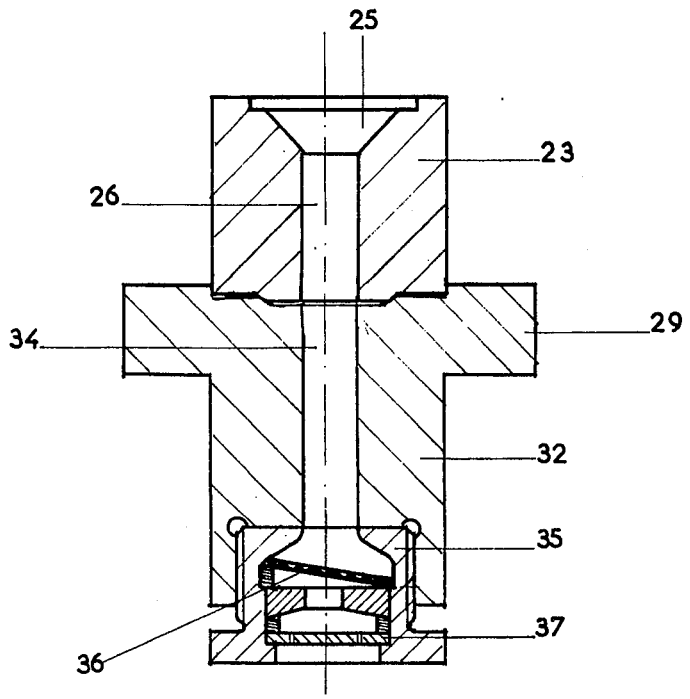
Figure 9:
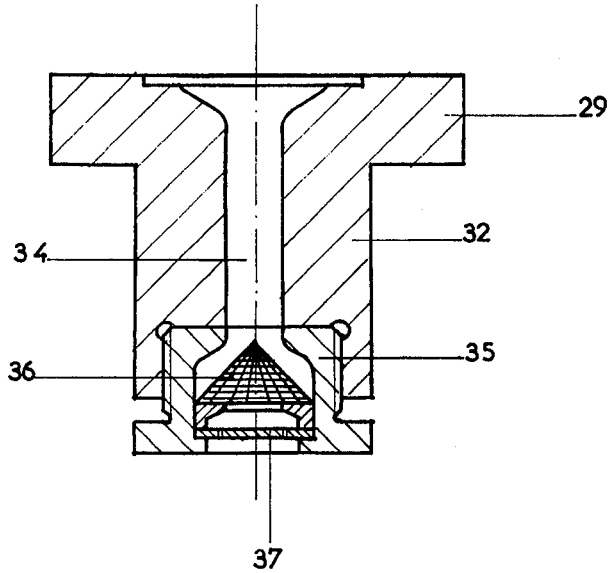
Figure 10:
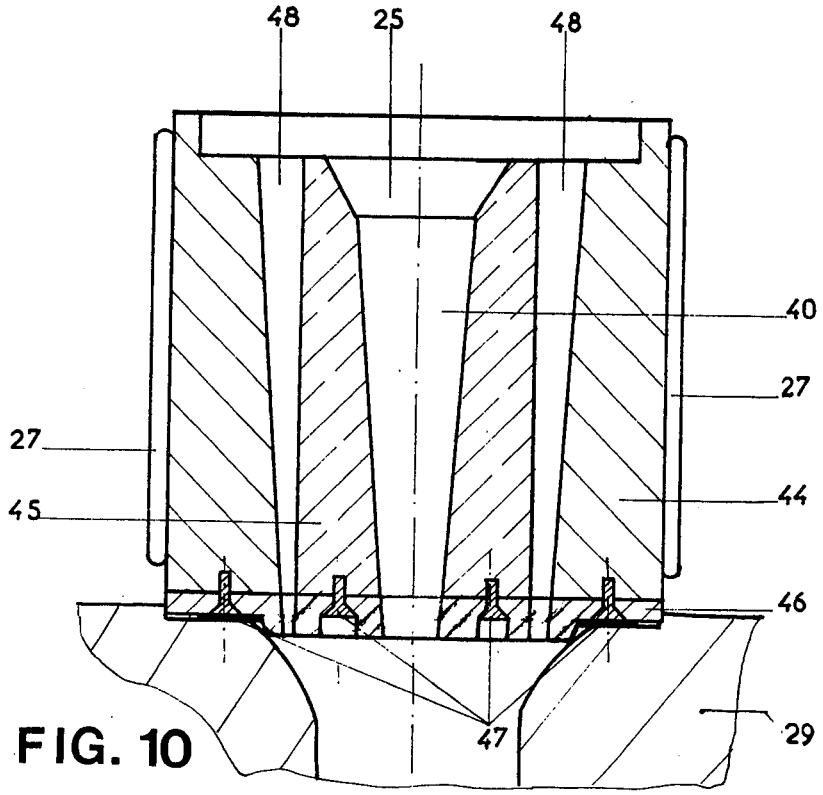

The passage 34 may be of cylindrical configuration as shown in FIGS. 2 and 8, or it may even be of generally cylindrical shape connected by a flared or bell-mouthed portion to the base of the block 23 (FIGS. 9 and 10).

The further Figures show a number of forms the passage 24, which is characteristic of the invention, may take.

Figure 3:
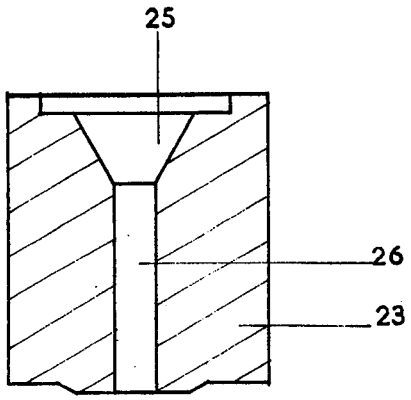
FIGS. 3 to 11 illustrate various embodiments of the heated block used in apparatus according to the invention.
Figure 4:
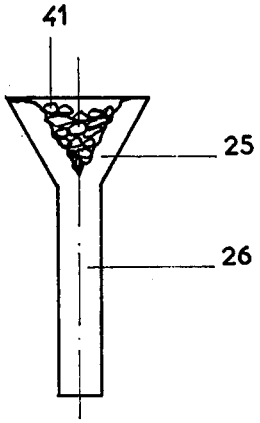
Figure 5:
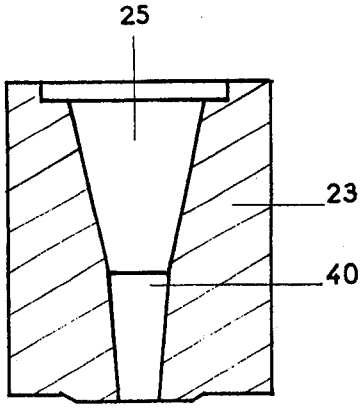

Referring to FIGS. 3 to 5, this passage is a single one. It passes thrugh the center of the heated block 23 and necessarily comprises at its inlet a frustoconical portion 25 communicating by its base either with a cylindrical passage 26 (FIGS. 2 and 3) or with a further frustoconical portion 40 (FIG. 5), the apex angle of which is smaller than that of the frustoconical portion 25.

In these embodiments, which have the advantage of being very simple to machine and to operate, the grains of polymer which are fed in at 20 by means of a pusher screw fill the conical cavity 25. The grains which come into contact with the walls of the truncated cone 25 heated by the collar 27 are rapidly brought to melting temperature. On the other hand, the polymer 41 (see FIG. 4) situated in the center of the cavity 25 melts much more slowly because of the poor heat conductivity of the polymer. Thus a preferential flow of the peripheral polymer is produced in the passage 26 or 40. The viscosity gradient is thus obtained in the conical cavity 25 itself. This is easily proved by withdrawing, after cooling, the polymer which has been molded in the block. Especially when the treatment temperature is too low it is found that not yet molten grains 41 are present in the center of the cavity 25 (FIG. 4).

Figure 6:
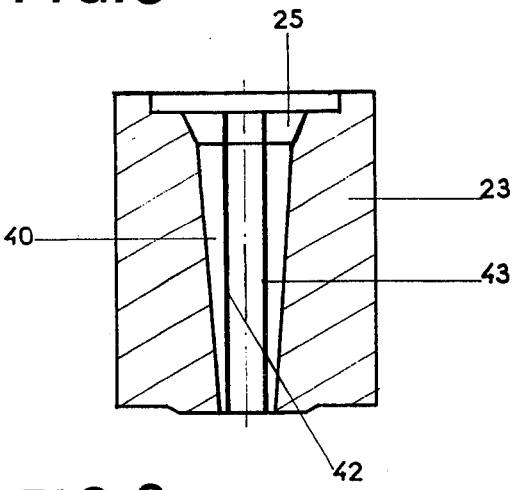
Figure 7:
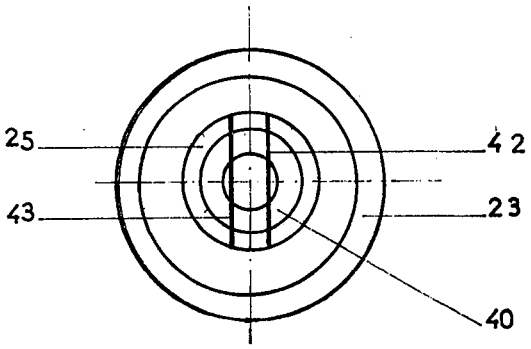

FIGS. 6 and 7 show in longitudinal cross-section and in plan view respectively, an improved block. Two thin strips 42–43 of a material which is a bad conductor of heat, such as inconel (nickel-chromium-iron alloy) type 600 for example, are placed in the passage.

The said strips extend from top to bottom in the passage so as to there form partitions. This arrangement has the advantage of augmenting the viscosity gradient by breaking the heat exchange.

FIGS. 8 and 9 schematically show an advantageous improvement of the apparatus according to the invention. According to this improvement the screen 36 instead of being perpendicular to the axis of the passage 34, that is to say horizontal as is customary, is inclined relative to the horizontal, that is to say relative to the flow of molten polymer. In combination with the shape of the central passage this inclination considerably augments the viscosity gradient. The screen 36 may be planar, but inclined (see FIG. 8), or of conical configuration (see FIG. 9) with the apex directed toward the transfer passage 34, whereby the preferential distribution of the polymer prior to its passage into the spinnerette 37 is yet further facilitated.

Figure 11:
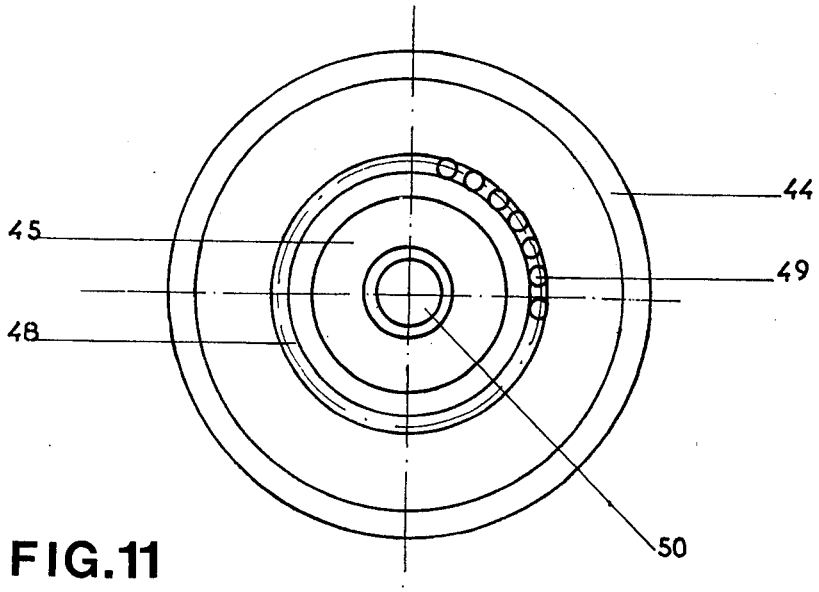

FIGS. 10 and 11 show a further improved embodiment of the block 23 characteristic of this apparatus, longitudinal cross-section (FIG. 10) and in plan view (FIG. 11) respectively.

This block 23, which is also of aluminum duraluminum or conductive light alloy, is essentially formed of two concentric rings 44 and 45 of generally conical configuration, which are open at the inlet and joined together by their bases on a perforated disc 46 with the aid of screws 47 or similar means. The ring 45 is arranged in such a manner tha that the polymer originating in the connector 20 is distributed in the two separate passages, i.e. the central passage 25–40 and the annular pasage 48 respectively. Since the chamber block 23 is heated by the peripheral collar 27 it is clear that the temperature of the polymer situated in the annular passage 48 will be higher than that of the polymer situated in the central passage 25, the more so since the conductivity of the polymer is quite poor.

The effect of the viscosity gradient can be augmented by making the ring 45 of a material the thermal conductivity of which differs from that of the material of the ring 44 (for example 44 of duraluminum and 45 of brass).

The bottom disc 46 is formed with orifices 49 and 50 respectively, which coincide with the bases of the annular passage and the central passage.

Such a device has numerous advantages since it remains easy to machine and makes possible a large throughput and a maximum viscosity gradient.

It is also possible to advantageously replace the feed by a pusher screw, which limits the spinning output to the melting capacity of the heating block, either by means of an extruder or a pump. In this event the heating block ensures no more than the production of the viscosity gradient. This embodiment has the advantage of not requiring the block to be heated to an excessive degree, which could lead to degradation of the polymer as a result of oxidation, and especially of not limiting the spinning output, i.e. the productivity of the installations.

Figure 12:
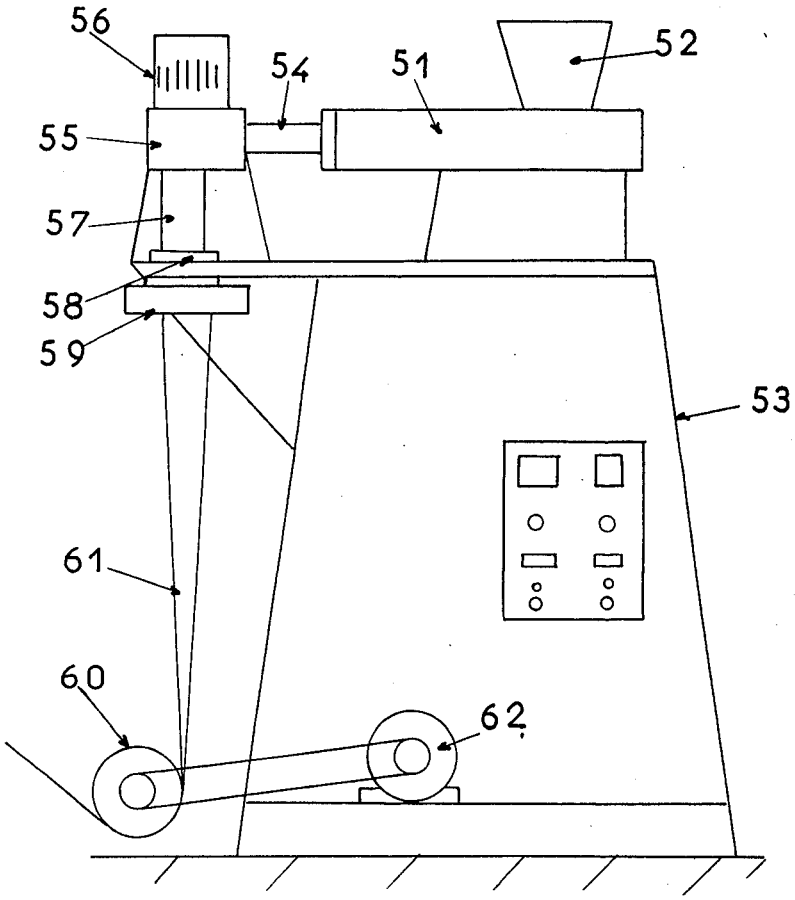
FIG. 12 illustrates a complete installation according to the invention in which the means for feeding the polymer under pressure comprise an extruder and a metering pump.

Such an embodiment is illustrated in FIG. 12, the installation comprising, in this case a single screw extruder 51 fed with polymer by means of a charge hopper 52 and mounted on a frame 53, a transfer passage 54 feeding the molten polymer to a metering pump 55 controlled by a variable speed motor 56, a heating block 57 according to the invention, a spinning head 58, a cooling air device 59 and take up means 60 for the extruded yarn 61, controlled by a motor 62.

Figure 13:
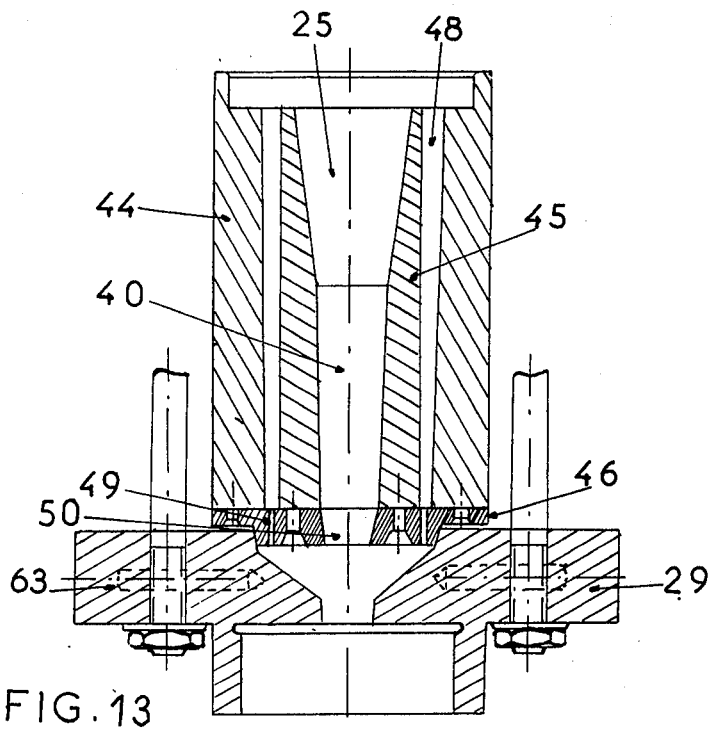
FIGS. 13 and 14 show, in longitudinal section, and in underneath plan, a heating block usable in the installation of FIG. 12.
Figure 14:
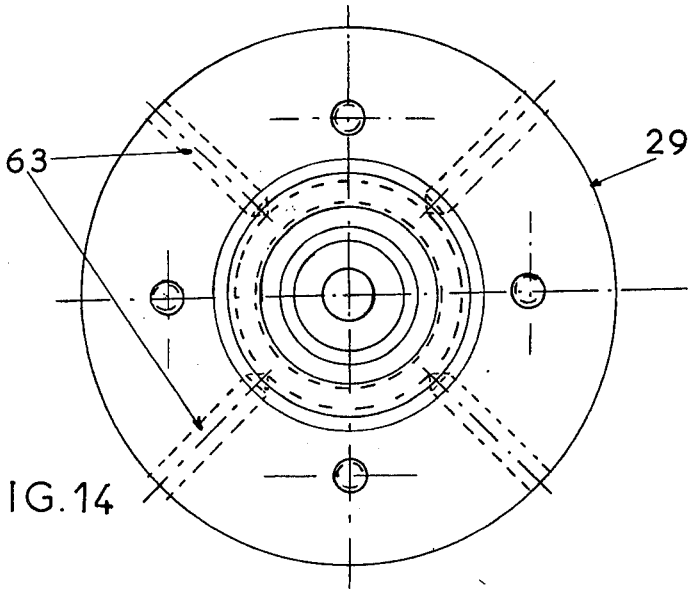

According to this embodiment, it is possible to utilize a heating block 57 such as shown in FIGS. 13 and 14. This block, contrary to the block similarly illustrated by FIGS. 10 and 11 only necessitates limited heating. In effect, as indicated earlier, in this case the block assures no more than the production of a viscosity gradient.

The heating block 57 illustrated in FIGS. 13 and 14 being in conception similar to that illustrated in FIGS. 10 and 11 will not be described in detail, and the same element will be designated by the same reference numerals as those utilized in FIGS. 10 and 11. The principle difference between this construction and that illustrated in FIGS. 10 and 11 resides in the clamping plate 29 which is heated by means of cartridge heaters 63 (for example electrical resistance heaters).

Moreover, in order to improve the efficiency of the apparatus the dimensions of different parts of the block as well as the nature of the material in which the block is formed, have been modified.

The block illustrated in FIGS. 13 and 14 has the following characteristics:

- the piece 44 formed of duraluminum has:
  - an exterior diameter of 77 mm
  - an interior diameter of the upper crown of 50 mm
  - an interior diameter of the lower crown of 46 mm
  - a height of 120 mm
- the piece 45 formed in stainless steel has:
  - an exterior diameter of 38 mm
  - a height of 108 mm
  - a diameter of the upper frustoconical parts 25 of 32 mm
  - a diameter of the lower frustoconical parts 25 of 20 mm
  - a height of the upper frustoconical parts 25 of 50 mm
  - a diameter of the lower frustoconical part 40 of 16 mm
- the piece 46 formed in soft iron:
  - a central conical orifice 50 of an upper diameter of 16 mm and a lower diameter of 12 mm
  - 44 orifices 49 of diameter 2 mm
- the piece 29 is formed in steel.

It is clear that the output also depends on the diameter of the central passage at the outlet of the block. A skilled person can readily determine, by calculating, the dimensions and the profile of the passages as a function of the rheological parameters of the material available to him and the results he seeks to obtain.

The apparatus of the invention may be used, as already mentioned, with any synthetic, thermoplastic polymers which are spinnable in molten state. Nevertheless, it is particularly suitable for processing polyolefins, especially isotactic polypropylene.

The extruded yarns having potential crimp and continuous filaments obtained in this manner may be utilized as such, or, optionally after twisting, interlacing, combining, weaving, knitting, etc. or even chopping to the form of discontinuous fibres, i.e. in the form of bats (so-called "spunbonded" technique). Depending on requirements the crimp may be developed by simple cold drawings or by drawings and subsequent heat treatments.

As has already been said, such an apparatus is easy and economical to machine and to operate. Moreover, it promotes the flow of the polymer which is thus subjected to a homogeneous pressure at the center, whereby consequently the stagnation zones and the disadvantages resulting therefrom are eliminated. Furthermore, the output of treated polymer, and hence the productivity of the installations, is no longer restricted by the design of the melting-block itself, but by the delivery elements.

Finally, in this apparatus, the viscosity gradient is clearly increased between the polymer treated in contact with the walls and that which passes through the center of the passage, so that the textile properties of crimp, elasticity, bulk, voluminosity and strength are improved relative to the techniques described in the preamble. Furthermore, by experimenting with the configuration of the passages 24–40 and 48 it is possible to obtain a very diverse range of crimps.

The role of the melting-block being that of creating the viscosity gradient, the output of the melting-block is not limited either by itself as is the case with the devices described in the abovementioned Canadian Patents, but is, on the other hand, simply a function of the output of the feed element. This property makes it possible to advantageously employ the device, without any further modifications, with currently used and existing installations. An installation which is so equipped is flexible, easy to start and to stop, and to operate.

EXAMPLE 1

There is employed an installation conforming to FIG. 1 and a block with a pusher screw of thirty millimeters diameter, having the following characteristics:

- the speed of the pusher screw 1 of 30 millimeters diameter is 11 r.p.m., i.e. an output of about 0.5 kilograms per hour;
- the polymer charged into the hopper 2 in granulated form is isotactic propylene sold by Societe Normande des Matieres Plastiques under the name PRYLENE GL 1840, having a grade measured at 230° C under 2.16 kilograms of pressure of 5.8 g/10 minutes;
- the melting point 23, as shown in FIG. 3 is of duraluminium;
- the diameter of the base of the frustoconical portion 25 is 52 mm;
- the height of the frustoconical portion 25 is 23 mm;
- the height of the cylindrical portion 26 is 55 mm;
- the diameter of the cylindrical portion 26 is 12 mm;
- the temperature of the block 32 is 280° C;
- the screen 36 is horizontal;
- the spinnerette 37 has 100 cylindrical orifices of 38/100 mm diameter;
- the pressure of air at ambient temperature delivered at 39 is 0.6 bar;
- the take-up speed of the bundle 5 below the spinnerette 37 is 70 m/min;
- the draw ratio between the roller sets 8–9 and 10–11 is 3.5;
- the temperature of the rollers of the drawing system is ambient temperature;
- the average count of the bundle 5 before drawing is 1160 dtex 486 g/h;
- the wind-up speed of the yarn 12 wound at 16 is 245 m/mins;
- the average count of the drawn filaments of the bundle 12 is 3.5 dtex.

After drawing, the yarn obtained is crimped, voluminous, elastic. It has the following characteristics:

- a breaking strength of 4 g/dtex;
- an elongation at break of 23%;
- a crimp of individual filaments which is of helicoidal type and inverse S and Z pitch along the filaments with small helical pitch diameter and amplitude:
- a crimp coefficient of 0.81.

The crimp coefficient is measured in the following manner:

- after drawing, samples are placed in a ventilated oven at 130° C for ½ an hour. The crimp coefficient CF is then measured with the aid of the following formula:

$$CF = 1 - \frac{\text{length of the relaxed filament}}{\text{length of the filament extended to maximum}}$$

The nearer the crimp coefficient (CF) comes to one, the more intense is the crimp.

EXAMPLE 2

By operating with the above parameters, it has been fount that:

a) the crimp is the greater the higher are the rate of pre-orientation and the drawing ratio;
b) the addition of additives such as zinc stearate does not noticeably improve the flow properties of the polymer;
c) in order to prevent an irregular creep of the filaments it is absolutely necessary to cool the filaments at the outlet of the spinnerette, and that an excessively high pressure of the cooling air, that is too rapid cooling, causes creep inside the spinnerette.

EXAMPLE 3

The Example is repeated, this time using a melting block 23 of the kind shown in FIG. 5 and having the following characteristics:

- the inlet diameter of the frustoconical portion 25 is 52 mm;
- the height of portion 25 is 23 mm;
- the diameter of the base of the frustoconical portion 40 connected to the apex of portion 25 is 30 mm;
- the height of portion 40 is 55 mm;
- the diameter of the base of the portion 40 is 12 mm.

The yarns obtained have characteristics similar to those of the yarns of Example 1.

EXAMPLE 4

Example 1 is repeated, using the same block 23 as in Example 3 into which block two partitions of Inconel 600, 0.5 mm thick and spaced apart by 6 millimeters, have been placed.

The yarns so obtained have a crimp which is better than that of the yarns of Example 1.

EXAMPLE 5

Example 1 is repeated by this time inclining the screen 36 by 30° as shown in FIG. 8.

The phenomenon of crimp and its intensity are therefore emphasized.

EXAMPLE 6

Example 1 is repeated by replacing only the pusher screw by a SAMAFOR extruder having a screw of 30 mm diameter and 114 cm length. The polypropylene is brought to the block 23 in molten state, the rate of rotation of the extruder screw at 1 is adjusted to 16 r.p.m., thus the hourly production amounts to 2 kilograms per hour.

The other conditions are regulated as follows:
- the temperature of the entry body is 200° C;
- the temperature of the exit body is 230° C;
- the temperature of the connector 20 is 250° C;
- the temperature of the block 23 as shown in FIG. 3 is 260° C;
- the temperature of the block 32 is 280° C;
- the pressure of the cooling air is 1 bar;
- the take-up speed of the bundle 5 below the spinnerette is 100 m/min;
- the average count of the undrawn bundle is 3630 dtex;
- the hourly production rate is 2.2 kg/h;
- the drawing ratio is 4;
- the winding up speed is 400 m/min;
- the average count of single filaments after drawing is 9 dtex;
- the characteristics of filaments is as follows:
  - the breaking strength is 4 g/dtex;
  - the elongation at break is 35%;
  - the crimp coefficient CF is 0.72%.

EXAMPLE 7

Example 6 is repeated, using a block 23 having a central passage and an annular passage which are concentric, such as shown in FIGS. 10 and 11, and having the following characteristics:
- the piece 44 of duraluminum has an external diameter of 77 mm;
- the inner diameter of upper ring is 50 mm;
- the inner diameter of lower ring is 46 mm;
- the height is 58 mm;
- the piece 45 of brass has an outer diameter of 38 mm;
- a height of 48 mm;
- a diameter of upper frustoconical portion 25 is 32 mm;
- a diameter of lower frustoconical portion of 20 mm;
- a height of frustoconical portion 25 of 18 mm;
- the diameter of lower frustoconical portion 40 is 16 mm;
- the piece 46 of duraluminum has a central conical orifice 50 of diameter 15–16 millimeters;
- 42 orifices 49 of 2 mm diameter.

Extrusion conditions are identical to Example 6, except that:
- the take-up speed of the bundle 5 below the spinnerette is 100 m/min;
- the average count of undrawn bundle is 3,600 dtex;
- the hourly production rate is 2.160 kg;
- the drawing ratio is 4;
- the wind-up speed is 400 m/min;
- the average count of filaments after drawing and stabilizing is 9 dtex:
- the characteristics of filaments are:
  - a breaking strength of 3.8 g/dtex;
  - an elongation is break of 35%;
  - a crimp coefficient of 0.76.

EXAMPLE 8

Example 6 is repeated by replacing the block 23 having a single passage 24 by a melting-block of the same overall also of du-aluminum, but formed with 90 holes of 4 millimeters diameter spaced apart by about 1 millimeter (that is to say in accordance with the teaching of Canadian Patent No. 884,962).

It is found that with this block type and under the identical conditions as in Example 6 it is very difficult to produce a yarn.

The take-up speed of the bundle below the spinnerette is 38 m/min;
- the count of the unstretched bundle is 9950 dtex;
- the hourly production rate is 2.200 kg;
- the drawing ratio is 4;
- the wind-up speed is 152 m/min;
- the average count of the drawn filaments is 24 dtex;
- the characteristics of these filaments are:
  - a breaking strength of 2 g/dtex;
  - an elongation at break of 50%;
  - a virtually non-existent crimp;
  - a crimp coefficient of 0.07%.

EXAMPLE 9

Example 6 is repeated by replacing the polypropylene by a low pressure polyethylene sold by the Company NAPHTACHIMIE under the name NATENE 60550 the grade of which, measured at 190° C, under 2.16 kg pressure is 5.9 g/10 min.

The temperatures are adjusted in the following manner:
- the temperature of the entry body is 160° C;
- the temperature of the exit body is 180° C;
- the temperature of the connector 20 is 190° C;
- the temperature of the block 23 is 190° C;
- the temperature of the block 32 is 220° C;
- the take-up speed of the bundle under the spinnerette is 60 m/min;
- the drawing ratio is 3.5;
- the wind-up speed is 210 m/min;
- the average count of the drawn filaments is 17 dtex;
- the characteristics of the filaments are as follows:
  - a breaking strength of 2 g/dtex;
  - an elongation at break of 38%;
  - a crimp coefficient of 0.56% after 30 minutes exposure at 100° C.

EXAMPLE 10

In the installation illustrated by FIG. 12 provided with a melting block according to FIGS. 13 and 14, one treats the same polymer as in Example 1, that is to say, polypropylene sold by Societe Normande des Matieres Plastiques under the name PRYLENE GL 1840.

The polypropylene is melted in the melting block 23 by means of a single screw extruder 51 of 30 mm diameter, and 60 centimeters in length, sold under the trade name YVROUD, and of a metering pump 55. The extrusion spinnerette comprises 95 holes of 0.6 mm in diameter.

The conditions of operation are as follows:
the temperature of the body at entry is 185° C;
the temperature of the body at exit is 190° C (for the extruder 51)
the temperature of the passage 54 is 230° C;
the temperature of the dosage pump 55 is 240° C;
the temperature of the spinning head 27 is 280° C;
the pressure of the cooling air is 1 atmosphere;
the speed of feed of the bundle 61 is 230 m/minute under the spinnerette;
the draw ratio is 3.5.

The yarn obtained has a very good crimp, is very fine and very dense.

EXAMPLE 11

Example 10 is repeated, but instead of polypropylene, one extrudes polyamide 6 in the form of granules. The conditions of spinning are, of course, different and, in the present case, the temperature of spinning at the level of the transfer passage is 260° C and the extrusion temperature is around 290°–300° C, the speed of extrusion being 190 m/minute.

After the drawing the draw ratio of 3.5, one obtains a crimped yarn.

The above Examples illustrate perfectly that the teachings of Canadian Patent No. 884,962 are not compatible in combination with the extruder since, on the one hand, they lead to extrusion difficulties and, on the other hand, and above all, they do not give yarns which crimp.

By contrast, the apparatus in accordance with the invention makes it possible to obtain yarns of improved characteristics and this apparatus is adaptable to existing machinery.

It is obvious that the invention is not limited to the Examples given above, and that it can readily be applied to all material susceptible to be extruded by melting, such as polyamides, polyesters and other polyolefins.

If, in the present case, the invention has been described as having a larger viscosity of the polymer at the interior than at the exterior, it can be obtained by lateral heating of the block, it is obvious that the invention covers equally all equivalent solutions for obtaining of differential viscosity between the centre and periphery of the polymer.

Thus, one does not depart from the invention if one cools the exterior of the block in a manner to have a viscosity which is greater at the exterior than at the interior of the polymer.

Moreover, the apparatus according to the invention can be disposed upstream of the spinnerette. In the case where the polymer is discharged by a pump, it will advantageously be disposed between the pump and the spinnerette but it can equally be disposed between the pump and the extruder.

Moreover, it is obvious that the invention can equally be applied to installations permitting the polymerization and spinning continuously.

We claim:

1. Apparatus for the production of a yarn having a potential crimp, said apparatus comprising, in combination:

(a) means for feeding polymer under pressure comprising an extruder or a metering pump (1);

(b) a block (23) connected to the outlet of said feeding means, said block having a central passage (24–25) therethrough for the passage of polymer from said feeding means to a spinning head, a frusto-conical upstream portion (25) of said central passage converging in a downstream direction;

(c) heat exchange means (27) on said block (23) for imparting to the polymer, as it passes through passage (24) a temperature differential between the polymer at the center of the passage and the polymer at the walls of the passage;

(d) a spinning head (32) mounted downstream from block 23 and including:

a single passage (34) for transferring polymer issued from the block (23) to a spinneret (37) the longitudinal axis of the said passge (34) being concentric with the longitudinal axis of the central passage (24) of block (23), and spinneret (37) formed with at least one row of holes therein, (e) and means (15–16) for receiving the yarn extruded through the spinneret (37).

2. Apparatus as claimed in claim 1, wherein the block (23) comprises a first member forming the said central passage (24) and a second member forming a concentric annular passage (48) surrounding said central passage (24) and extending over the full axial length of the block (23), and further comprising a perforated disc (46) to which said first and second members are connected.

3. Apparatus as claimed in claim 1, wherein the single central passage comprises a frusto-conical upstream portion and a cylindrical portion.

4. Apparatus as claimed in claim 1, wherein said single central passage comprises two interconnected frusto-conical portions, the apex angle of the upstream portion being greater than the apex angle of the downstream portion.

5. Apparatus as claimed in claim 1, wherein the central passage further comprises at least two partition members of a material which is a poor conductor of heat, said partition members extended longitudinally of said central passage.

6. Apparatus as claimed in claim 2, wherein the central passage and the annular passage are frusto-conical and converge in a downstream direction.

7. Apparatus as claimed in claim 2, wherein said first member disposed between the central passage and the annular passage is made of a material of different

8. Apparatus as claimed in claim 1, comprising a filter screen (36), placed between the single passage (34) for transferring the polymer and the spinneret (37), said filter being inclined relative to the axis of said single passage (34).

9. Apparatus as claimed in claim 8, wherein the screen has the shape of a truncated cone, converging in upstream direction.

* * * * *